US005823826A

United States Patent [19]

Ward et al.

[11] Patent Number: 5,823,826

[45] Date of Patent: Oct. 20, 1998

[54] FILTERED CIRCUIT CONNECTOR WITH FRAME

[75] Inventors: Bobby Gene Ward, King; Larry George Novotny, Clemmons; James Ray Coller, Kernersville, all of N.C.

[73] Assignee: The Whitaker Corporation, Wilmington, Del.

[21] Appl. No.: 741,858

[22] Filed: Oct. 28, 1996

Related U.S. Application Data

[60] Provisional application No. 60/008,083 Oct. 30, 1995.

[51] Int. Cl. [6] ..... H01R 13/66

[52] U.S. Cl. ..... 439/620

[58] Field of Search ..... 439/620; 333/181–185

[56] References Cited

U.S. PATENT DOCUMENTS 4,265,506 5/1981 Hollyday ..... 439/620
4,983,935 1/1991 Mouissie ..... 439/620
5,066,931 11/1991 Thelissen ..... 333/182
5,286,221 2/1994 Fencl et al. ..... 439/607

FOREIGN PATENT DOCUMENTS 0 364 015 4/1990 European Pat. Off. .

*Primary Examiner*—Gary F. Paumen
*Attorney, Agent, or Firm*—Bradley N. Ditty

[57] ABSTRACT

An electrical connector assembly (1) having a housing (10) and a subassembly (80) connected thereto for eliminating circuit-degrading EMI. Subassembly (80) includes a substrate (20) mounted to a frame (30). Substrate (20) comprises a rigid board with circuit traces (25,26), electrical components (28), and a pin array (22) thereby defining an electrical circuit path. Frame (30) is electrically connected to the circuit path and comprises a robust, metallic piece having locking clips (36) for electrically and mechanically attaching subassembly (80) to housing (10).

13 Claims, 6 Drawing Sheets

Fig. 2
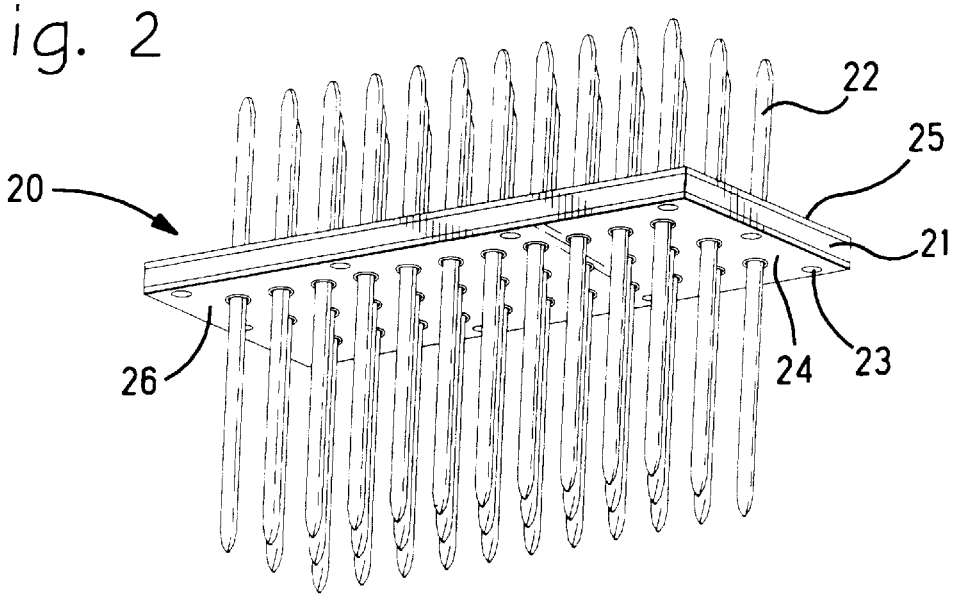
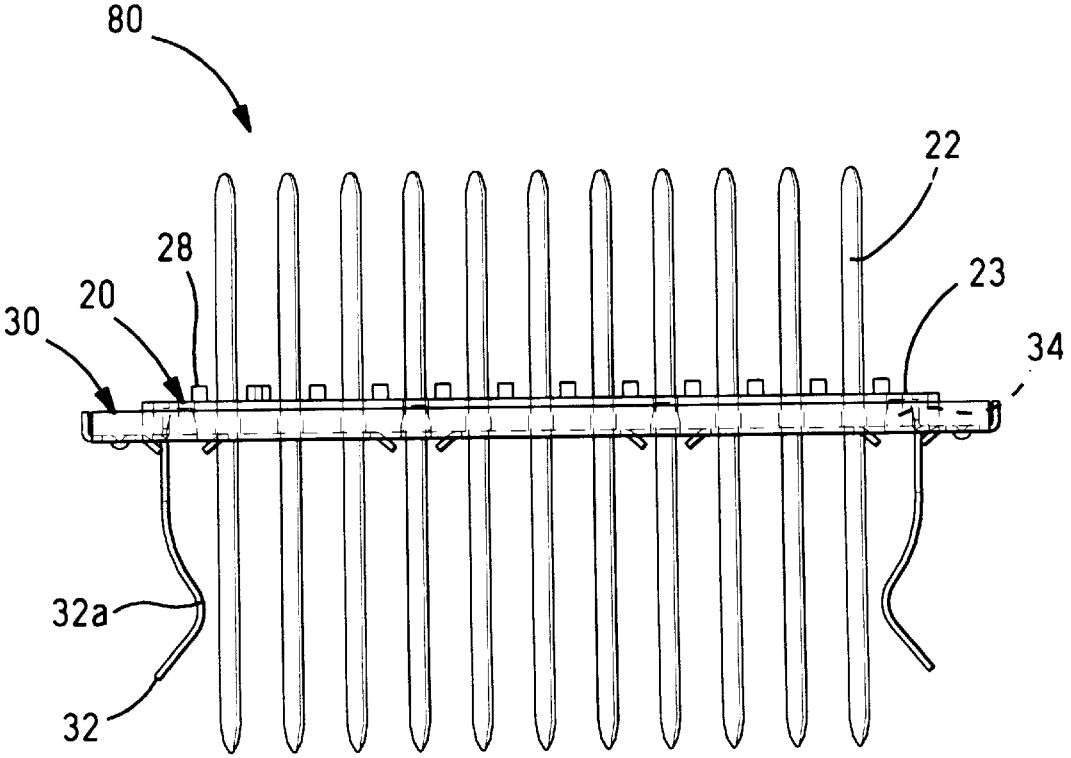
Fig. 5

FILTERED CIRCUIT CONNECTOR WITH FRAME

This application claims the benefit of U.S. Provisional Application(s) No(s). 60/008,083, Filed Oct. 30 1995.

The present invention relates to an electrical connector having electrical contacts, and, more particularly, to an electrical connector having a substrate mounted thereto, the substrate having electrical components mounted thereon which electrically interface with the electrical contacts.

BACKGROUND OF THE INVENTION

Electrical connectors having a substrate with electrical components mounted thereon are typically used in signal transmission paths of computers, radios, and other electronic equipment for filtering out electromagnetic interference (EMI). EMI is electrical or electromagnetic energy that causes undesirable circuit responses, circuit-degraded performance, or complete malfunctions in electronic equipment. To eliminate circuit-degrading EMI, a circuit may include EMI filter components mounted thereon comprising miniature or "chip" type capacitors (C), inductor plates (L), and some resistance (R). Such circuits are defined as RC and RL circuits and are known in the art as lowpass filters. Additionally, shields comprising ground planes are used to drain the circuit-degrading EMI to ground.

With the increased electronic content of motor vehicles, e.g. audio systems and intelligent engine control modules, the use of filtered connectors has become important for protecting the performance of the vehicle's electronic systems. Such filtered connectors must be of a structurally robust design so that they can withstand the harsh environmental conditions to which motor vehicle components are typically subjected, e.g. mechanical vibration, thermal cycling, and moisture vapor contamination. The foregoing conditions can cause degraded performance, breakage, or disconnection of the filter circuit. In general, however, the cost of producing a filtered connector suitable for use in motor vehicle applications is as important to both operating equipment manufacturers and suppliers as is the electronic performance of the component. Therefore, the overall problem to be solved by component suppliers is a minimization of cost without sacrificing the electronic performance or robustness of the filtered connector.

Prior motor vehicle type filtered connectors employ a flat flexible cable (FFC) substrate, e.g. a KAPTON material, with electronic: components mounted thereon. Such a prior connector is disclosed in U.S. Pat No. 5,286,221, wherein the FFC is press fit onto portions of a housing and the press fit connections are epoxied with a deposit of conductive epoxy material, thereby making a ground path connection between conductive traces on the FFC and the housing. However, such FFC connections are expensive and are subject to breakage due to mechanical vibration and are not, therefore, sufficiently robust. Additionally, since the epoxy deposits are inherently brittle when cured, the FFC connections are subject to thermal stress cracking and fracture at the conductive epoxied connections. Such cracking and fracture are due to mechanical vibrations, and to a mismatch of the thermal coefficient of expansion properties in the epoxy, the FFC, and the housing materials. The breakage and cracking will undesirably result in a disconnection of the filter circuit from the housing, and thus electrical continuity is inevitably lost between the housing and the traces on the FFC. Disconnection necessarily destroys the electrical continuity of the ground path, renders the filter circuit useless, and subjects the connector to circuit-degraded performance.

SUMMARY OF THE INVENTION

In view of the foregoing, it is an object of the present invention to provide an electrical connector at a minimum cost without sacrificing the electronic performance or robustness of the connector.

It is another object of the present invention to provide an electrical connector which reliably reduces or eliminates circuit-degrading EMI.

It is a further object of the present invention to provide a mechanically robust electrical connector suitable for use in motor vehicle applications.

It is another object of the present invention to provide an electronically reliable electrical connector suitable for use in motor vehicle applications.

It is a further object of the present invention to provide an electrical connector with thermal coefficient of expansion matching between selected component parts thereof.

It is yet another object of the present invention to provide an electrical connector with a ground path interface having high contact normal forces and low impedance.

It is a further object of the present invention to provide an electrical connector which is shielded and comprises an integral filter circuit.

It is still another object of the present invention to provide a low cost, highly manufacturable, filtered electrical connector suitable for use in motor vehicle applications.

Additional objects and advantages, within the scope of the appended claims, may become apparent to those skilled in the art upon examination of the following or may be learned from practicing the invention.

To achieve the foregoing objects, the present invention provides an electrical connector with an electrically conductive housing, and the housing comprises a connector subassembly receiving section and conductive subassembly locking sections. A connector subassembly is located in the subassembly receiving section, and the connector subassembly comprises a conductive frame and a substrate. The substrate comprises circuit traces and conductive members defining an electrical circuit path therebetween. The frame comprises substrate connecting sections and housing locking members, the frame is electrically connected to the electrical circuit path by the substrate connecting sections, and the frame housing locking members are electrically connected to the housing locking sections.

The frame is thereby electrically interposed between the substrate and the housing whereby electrical continuity is made from the electrical circuit path through the frame to the housing.

BRIEF DESCRIPTION OF THE DRAWINGS

FIG. 2 shows an isometric view of a filter circuit subassembly shown in FIG. 1.

FIG. 5 shows a frame-PCB subassembly according to the present invention.

DETAILED DESCRIPTION OF THE INVENTION

Figure 1:
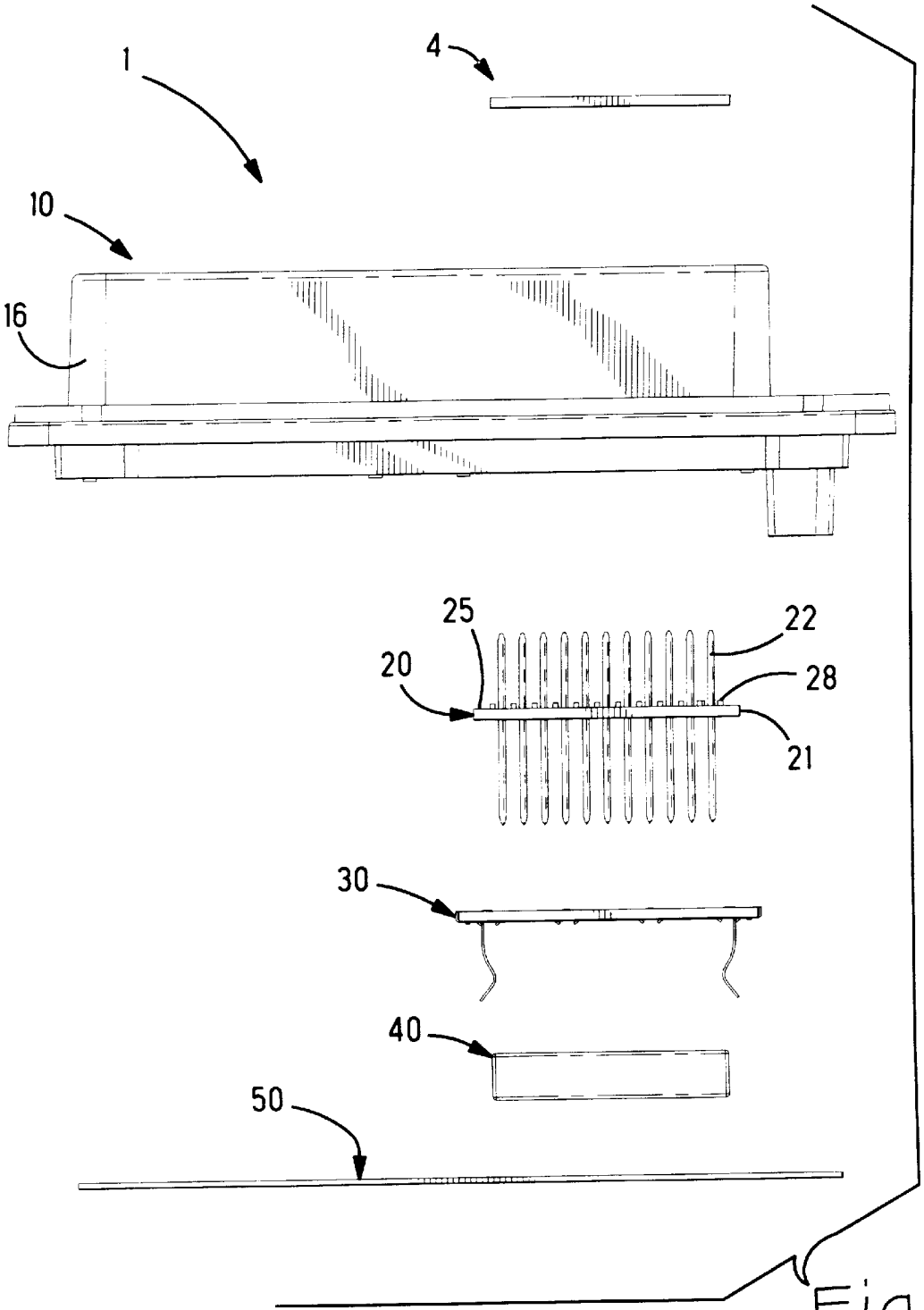
FIG. 1 shows an exploded view of an electrical connector assembly according to the present invention.

Referring to FIG. 1, an electrical connector assembly 1 according to the present invention will be described. Connector assembly 1 includes: a sealant material 4; a housing 10; a filter circuit subassembly 20 comprising a pin array 22; a conductive frame 30; a ferrite block 40; and an electronic component board 50. Sealant 4 is preferably a conventional, non-conductive, thermally or UV light-curable sealant material.

Figure 6:
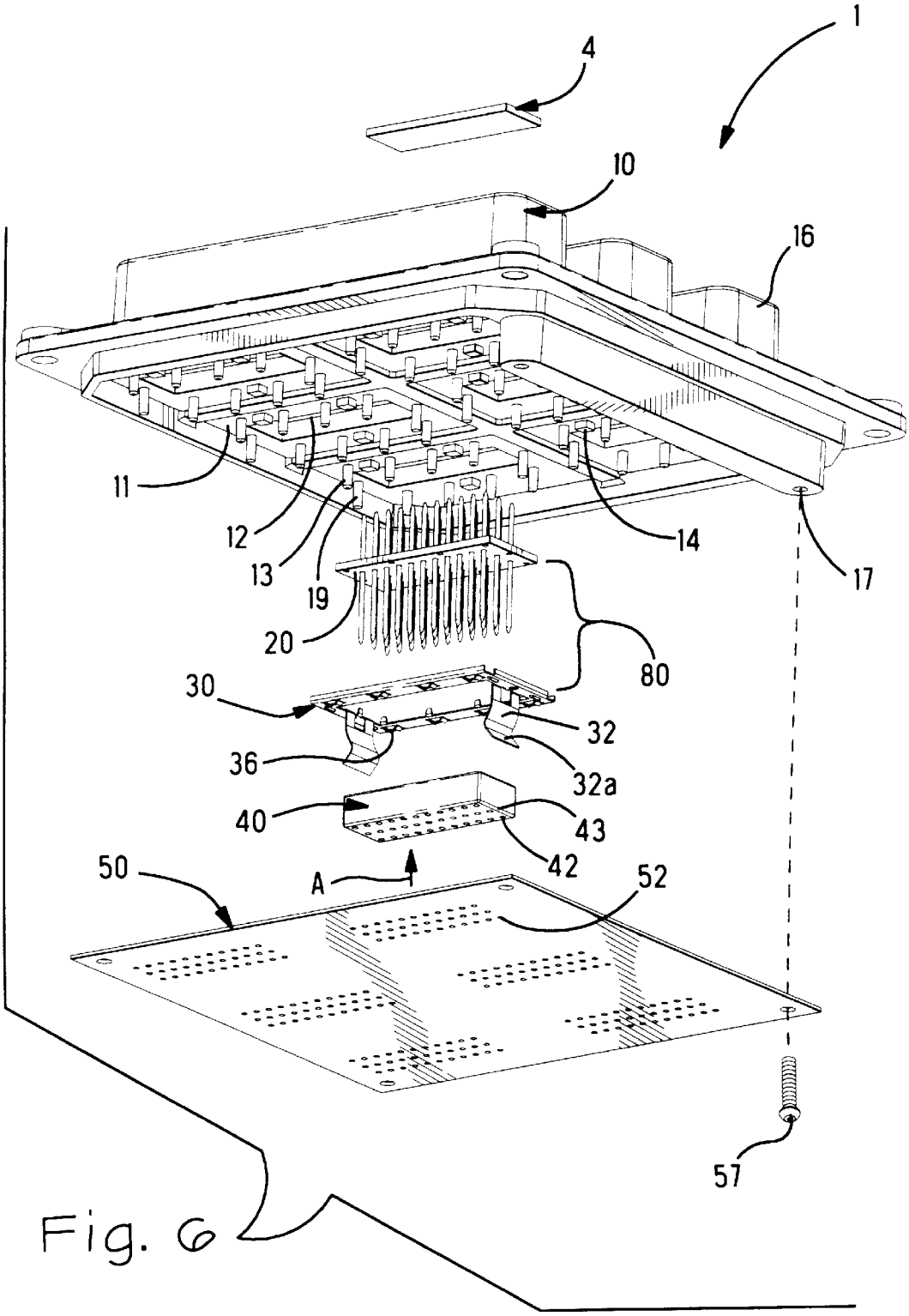
FIG. 6 shows an exploded isometric view of the electrical connector assembly of FIG. 1.

Housing 10 is preferably formed of a non-plated, die-cast aluminum material; however, a plastic material may be used as well. As best shown in FIGS. 1 and 6, housing 10 includes: a bottom face 11; subassembly receiving sections comprising apertures 12 for receiving pin array 22 therethrough; conductive subassembly receiving sections comprising tapered posts 13; frame supports 14; header sections 16 which are aligned with respective apertures 12 and comprise sealant receiving cavities 18 (FIG. 8); fastener receiving holes 17; and alignment sections comprising alignment posts 19. Posts 13 are strategically spaced around the periphery of respective apertures 12 for engaging frame 30, as will be described below.

Referring to FIGS. 1 and 2, filter circuit subassembly 20 includes a substrate comprising a rigid, electronic component board comprising a PCB 21 with conventional circuit traces 25 on a top side, and a ground plane 26 on a bottom side thereof (FIG. 2). Filter circuit subassembly 20 also comprises conductive members comprising the pins of contact pin array 22 which are inserted through PCB 21 and soldered to respective portions of circuit traces 25. Subassembly 20 includes conductive members comprising plated, tab receiving holes 23 which are electrically connected to ground plane 26 and portions of circuit traces 25. Further, subassembly 20 includes conductive members comprising electronic components 28 electrically connected to respective pins of pin array 22 by circuit traces 25. Electronic components 28 preferably comprise chip-type capacitors; however, components 28 may comprise tubular feed-through type capacitors, diodes, optical interface components, or other board-mountable electronic components.

Figure 3:
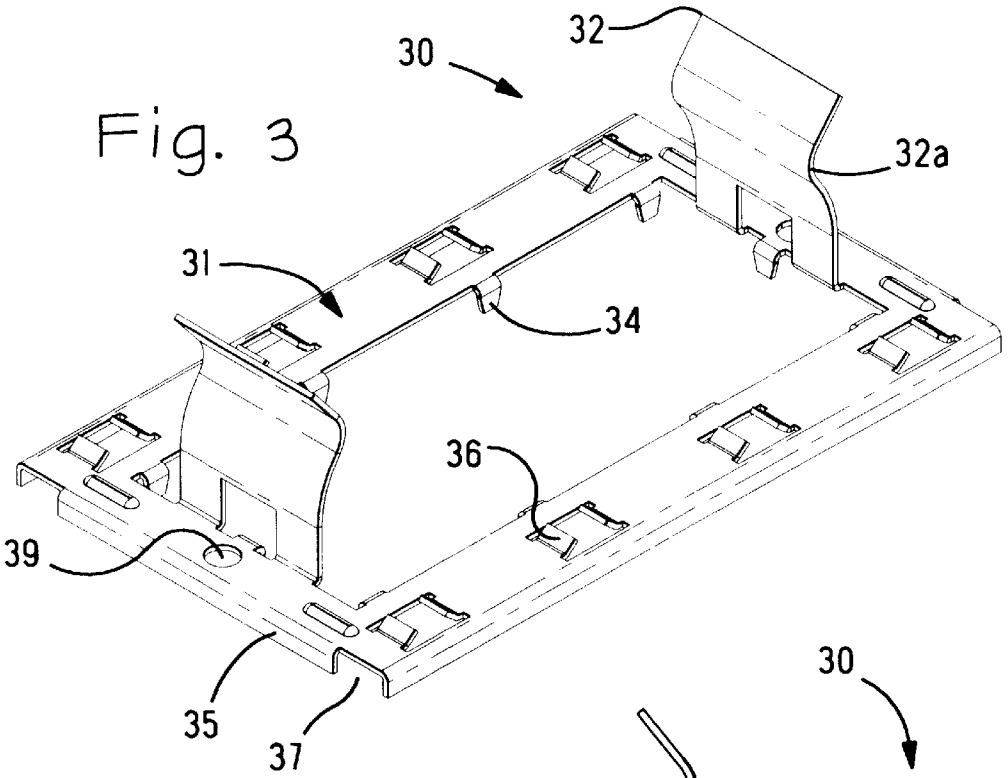
FIG. 3 shows an isometric view of the frame member of FIG. 1.
Figure 4:
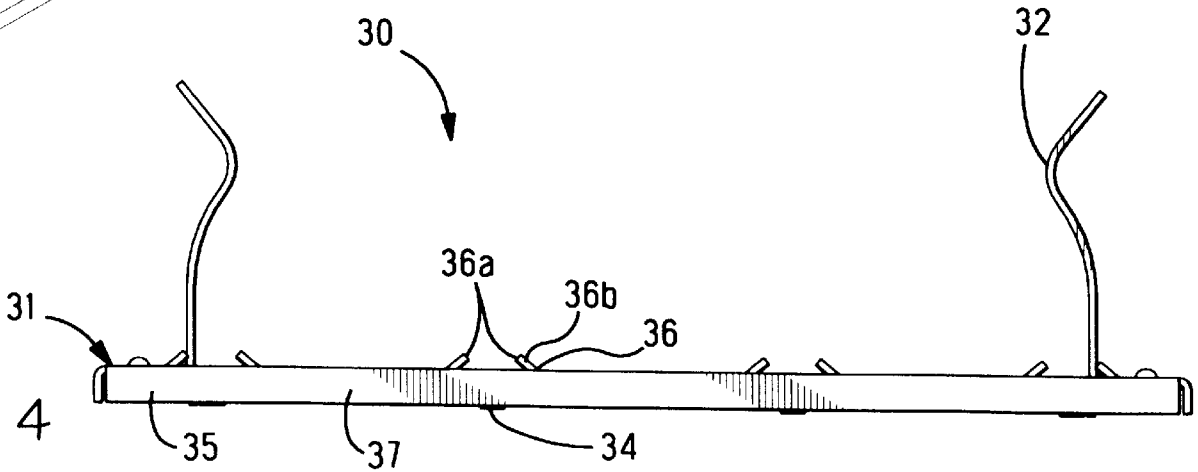
FIG. 4 shows a side view of the frame of FIG. 3.

Frame 30, which is best shown in FIGS. 3–4, preferably comprises a stamped and formed piece of copper alloy or phosphorous bronze material with a tin-lead plating thereon. Frame 30 includes a periphery 31 from which retaining memers comprising clips 32 extend, as shown in FIG. 1, toward ferrite block 40. Clips 32 include retaining bends 32*a* for holding ferrite block 40 adjacent to frame 30, as will be further described below. Periphery 31 also includes substrate connecting sections comprising solder tabs 34 which are sized to fit into tab receiving holes formed in PC board 20 for soldering thereto. Additionally, housing locking members comprising locking clip sections 36 extend from periphery 31. As best shown in FIG. 4, locking clip sections 36 include sharp sections comprising edges 32*a* formed on deflectable tabs 36*b* for frictionally receiving and electrically contacting posts formed on housing 10, as will be described below. Periphery 31 also includes alignment section receiving areas comprising holes 39 for aligning frame 30 with housing 10, as will be described below. The outer edges of periphery 31 comprise bent edges 35 which define a PCB receiving area 37.

PCB receiving area 37 receives PCB 20 therein and, as best shown in FIG. 5, a connector subassembly comprising a frame-PCB subassembly 80 is thereby made. In achieving objects of the present invention, frame-PCB subassembly 80 advantageously comprises an electrically continuous ground path with low impedance, as follows: from electrical contacts 22 which are electrically connected to electrical components 28 by circuit traces 25 on PCB 21; next, from electronic components 28 to the plurality of plated holes 23 which are electrically connected to electronic components 28 by circuit traces; and then, from plated holes 23 through a solder-type electrical connection to tabs 34 of frame 30. Further, frame 30 will be electrically connected to housing 10, as will be described below. Providing a plurality of solder connections between the ground plane of PCB 21, plated holes 23, and tabs 34 advantageously increases the shielding effectiveness of PCB 20 and decreases impedance.

An electrical component block comprising ferrite block 40, as best shown in FIG. 6, comprises: pin receiving holes 32 for receiving respective pins of pin array 22; and retention edges 43 for engagement with clips 32 of frame 30. PCB 50 comprises conventional circuit traces, and pin receiving holes 52. Fastener 57 is provided for attaching PCB 50 to housing 10, as will be further described below.

Figure 7:
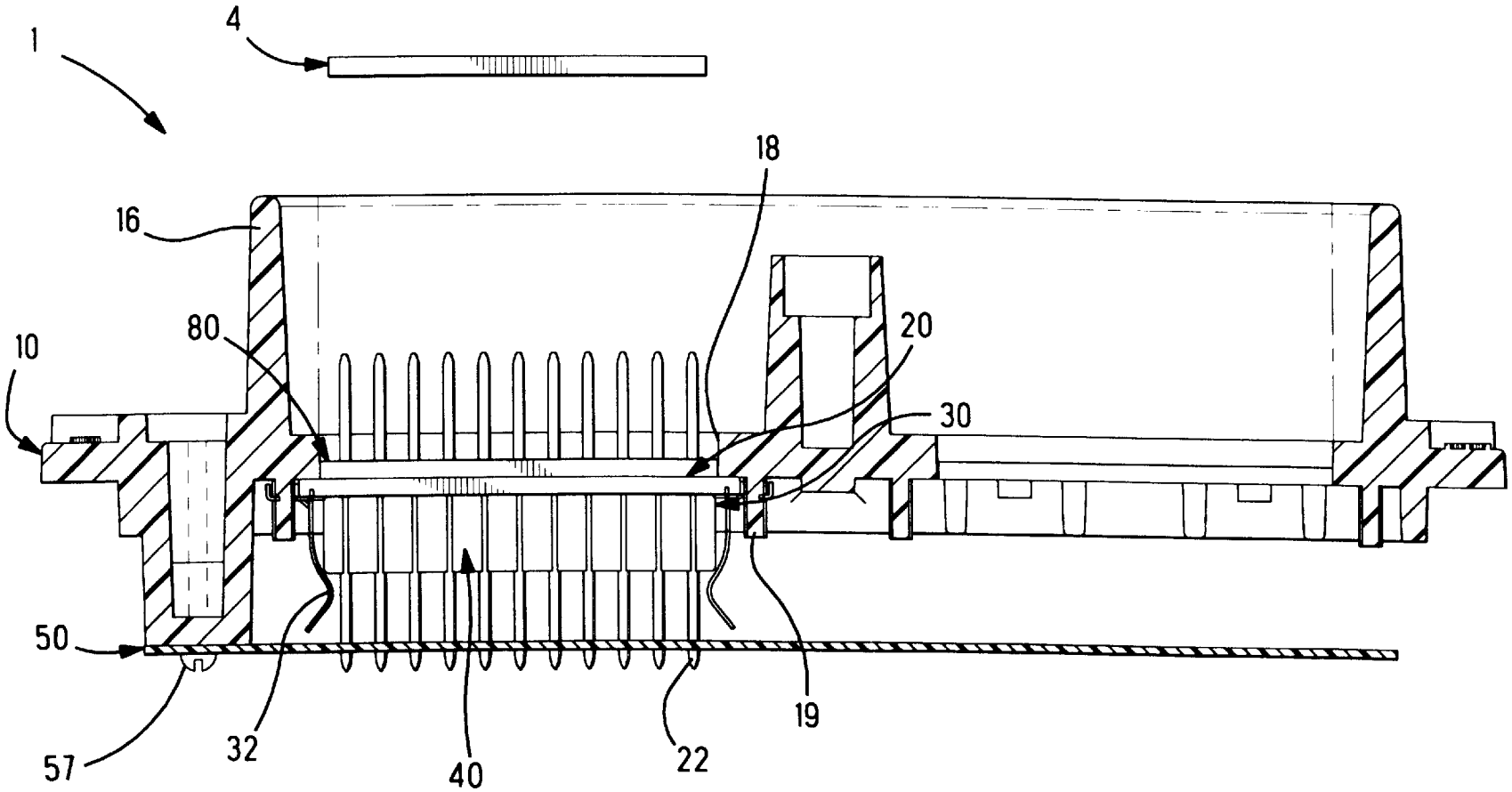
FIG. 7 shows a partial cross sectional side view of the electrical connector assembly of FIG. 1 when fully assembled.

Assembly of electrical connector assembly 1 will now be described with reference to the foregoing and to FIGS. 6–7. Assembly of filter circuit assembly 1 is accomplished by aligning a given assembly 80 with a respective aperture 12 of housing 10 so that frame 30 is generally interposed between substrate 20 and housing 10 and alignment posts 19 are aligned with post receiving sections 39. Additionally, posts 13 are aligned with respective locking clip sections 36. Ferrite block 40 is attached to sub-assembly 80 by moving ferrite block 40 in the direction of arrow A so that pins of pin array 22 are disposed in respective holes 42, and retaining bends 32*a* engage retaining edges 43, thereby attaching block 40 to subassembly 80 as shown in FIG. 7. As subassembly 80 is moved toward housing 10, pin array 22 will become located in aperture 12, alignment posts 19 are inserted into respective post receiving sections 39, and posts 13 will register with locking clip sections 36, thereby deflecting tabs 36*b*. Edges 36*a* will bite into the surfaces of tapered posts 13. Separating forces tending to separate frame 30 from housing 10 causes locking clip sections 36 to dig deeper into tapered posts 13, thereby effecting mechanically reliable, robust frictional retention of subassembly 80 to housing 10, which achieves an object of the present invention by resisting breakage or disconnection of the filter circuit due to mechanical vibration. No epoxy connections are required, and, in acheiving an object of the present invention, good electrical performance is assured by eliminating the epoxy potential breakage point, and production costs and time are kept low because no epoxy material need be used. Moreover, the copper alloy or phosphorous bronze material of frame 30 is preselected because it advantageously provides an excellent thermal coefficient match with the die cast aluminum material of housing 10, which achieves a further object of the invention by resisting breakage or disconnection of the filter circuit due to thermal stress cracking or fracture. Furthermore, deflectable legs 36 provide a high contact normal force against posts 13 thereby defining a low impedance electrical connection. Oxidation on the outer surfaces of posts 13 will be scraped off by sharp edges 36*a*, thereby advantageously assuring electrical ground path continuity between housing 10 and frame 30. Supports 14 are operative to support frame 30 adjacent housing 10.

Next, PCB 50 is attached to housing 10 by fasteners 57, and the pins of pin array 22 are located in holes 52 and are soldered to circuit traces on PCB 50. Finally, sealant material 4 is disposed in cavities 18 of header sections 16 and is cured for providing protection against contaminants, e.g. moisture vapor. It is important to note that when subassembly 80 comprises capacitors, a low-pass filter circuit is created, which achieves yet another object of the invention, i.e. filter circuit protection against circuit-degrading EMI. Moreover, this object is achieved by the shielding characteristics of header 10 and the ground planes on respective PCBs 21. Therefore, in view of the mechanical robustness and assured electrical continuity of connector assembly 1, the electrical reliability of connector assembly 1 is achieved.

Figure 8:
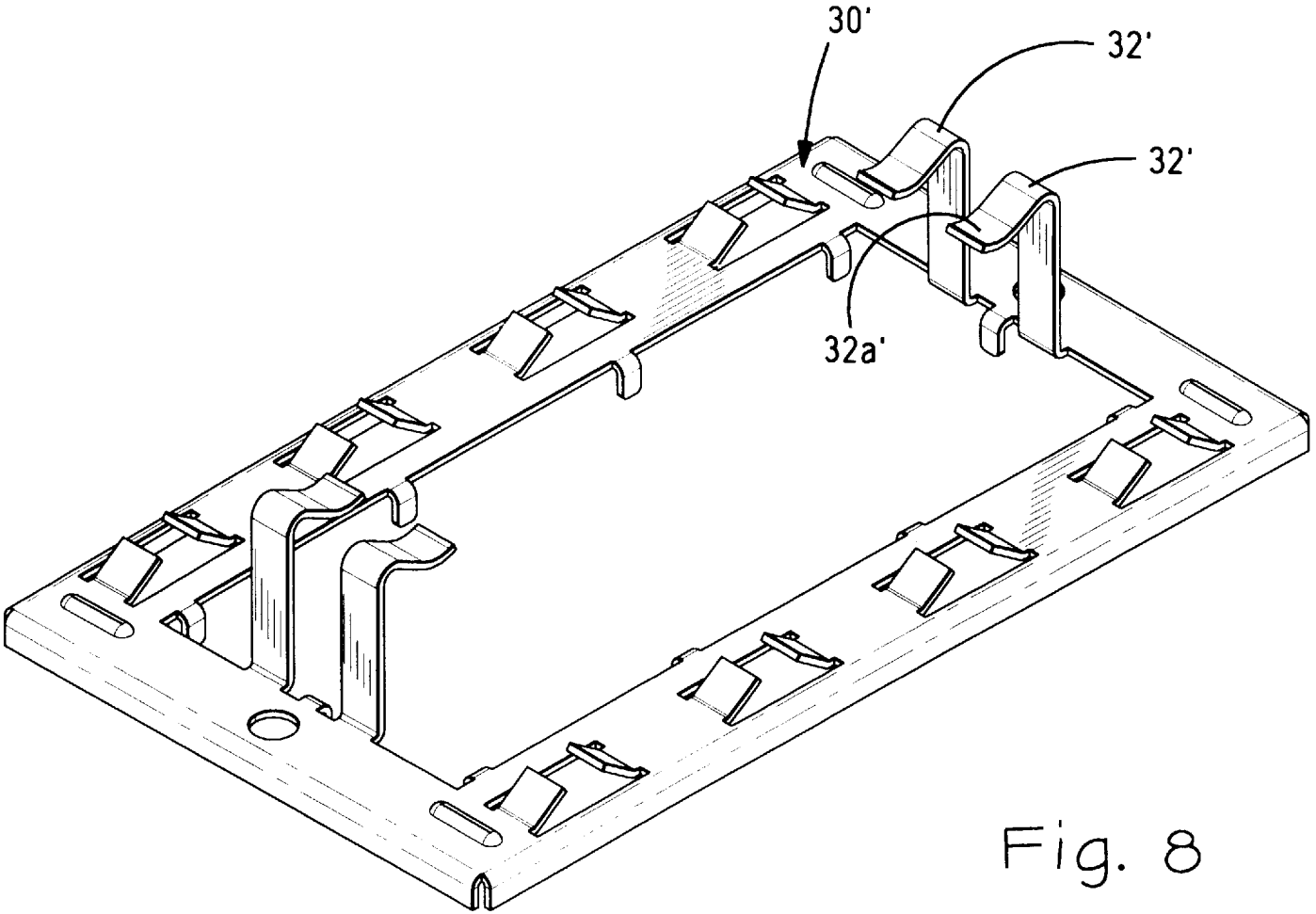
FIG. 8 shows an isometric view of an alternative embodiment of the frame of FIGS. 3–4.

FIG. 8 shows an alternative embodiment of frame 30 wherein clips 32 have been modified to provide generally L-shaped retaining members 32*a*' for retaining block 40 in close proximity to subassembly 80. L-shaped members 32*a*' provide good retention of block 40 to subassembly 80 as they are formed to fit adjacent an underside of block 40.

Thus, preferred embodiments of the present invention have been described, but it is to be understood that the invention is not to be strictly limited to such embodiments but may be otherwise variously embodied and practiced within the scope of the appended claims.

Accordingly, what is claimed is:

1. An electrical connector, comprising:

(a) an electrically conductive housing, said housing comprises a connector subassembly receiving section and conductive subassembly locking members, wherein said conductive subassembly locking members comprise posts;

(b) a connector subassembly located in said subassembly receiving section, said connector subassembly comprises a conductive frame and a substrate;

(c) said substrate comprises circuit traces and conductive members defining an electrical circuit path therebetween;

(d) said frame comprises substrate connecting sections and housing locking members, said frame is electrically connected to said electrical circuit path by said substrate connecting sections, and said frame housing locking members are electrically connected to said conductive subassembly locking members of said housing; and (e) said frame is thereby electrically interposed between said substrate and said housing whereby electrical continuity is made from said electrical circuit path through said frame to said housing.

2. The electrical connector of claim 1, wherein said conductive members comprise capacitors.

3. The electrical connector of claim 1, wherein said frame substrate connecting sections comprise solder tabs.

4. The electrical connector of claim 1, wherein said frame housing locking members comprise locking clips.

5. An electrical connector, comprising:

(a) an electrically conductive housing, said housing comprises a connector subassembly receiving section and conductive subassembly locking sections, wherein said conductive subassembly locking sections comprise posts;

(b) a connector subassembly located in said subassembly receiving section;

(c) said connector subassembly comprises a conductive frame, circuit traces, and conductive members defining an electrical circuit path therebetween;

(d) said frame comprises housing locking members, said housing locking members are electrically connected to said conductive subassembly locking sections by sharp sections formed on said housing locking members which bite into said conductive subassembly locking sections; and (e) said frame is thereby electrically interposed between said electrical circuit path and said housing whereby electrical continuity is made from said electrical circuit path through said frame to said housing.

6. The electrical connector of claim 5, wherein said housing locking members comprise locking clips.

7. The electrical connector of claim 6, wherein said locking clips are deflectable.

8. An electrical connector, comprising:

(a) an electrically conductive housing, said housing comprises a connector subassembly receiving section and conductive subassembly locking sections;

(b) a connector subassembly located in said subassembly receiving section;

(c) said connector subassembly comprises a conductive frame, circuit traces, and conductive members defining an electrical circuit path therebetween;

(d) said frame comprises housing locking members and retaining members, said housing locking members are electrically connected to said housing locking sections, and said retaining members extend away from said frame for retaining an electrical component block therebetween;

(e) an electrical component block supported by said frame retaining members; and (f) said frame is electrically interposed between said electrical component block, said electrical circuit path, and said housing whereby electrical continuity is made from said electrical circuit path through said frame to said housing.

9. The electrical connector of claim 8, wherein said retaining members comprise clips.

10. The electrical connector of claim 8, wherein said electrical component block comprises a ferrite block.

11. The electrical connector of claim 8, wherein said conductive subassembly locking sections comprise posts.

12. The electrical connector of claim 8, wherein said housing locking members comprise locking clips.

13. The electrical connector of claim 12, wherein said locking clips are deflectable.

* * * * *